US005412734A

United States Patent [19]

Thomasson

[11] Patent Number: 5,412,734

[45] Date of Patent: May 2, 1995

[54] APPARATUS AND METHOD FOR REDUCING ACOUSTIC FEEDBACK

[76] Inventor: Samuel L. Thomasson, 1038 E. Hearn Way, Gilbert, Ariz. 85234

[21] Appl. No.: 120,187

[22] Filed: Sep. 13, 1993

[51] Int. Cl.[6] ..... H04R 27/00

[52] U.S. Cl. ..... 351/83; 351/68.2; 351/68.4; 351/93

[58] Field of Search ..... 381/83, 93, 68.2, 68.4, 381/16; 379/392, 420; 84/675, 699, 702, 706, 692, 694, 696

[56] References Cited

U.S. PATENT DOCUMENTS

| | | | |
|---|---|---|---|
| 2,556,889 | 6/1951 | Sterner | 381/83 |
| 2,835,814 | 3/1956 | Dorf | 84/706 |
| 3,842,204 | 10/1974 | Leslie | 84/696 |
| 4,859,127 | 5/1986 | Loughlin | 381/16 |

OTHER PUBLICATIONS

Chowning, John M., "The Synthesis of Complex Audio Spectra by Means of Frequency Modulation", Computer Music Journal, pp. 46–54, Apr., 1977.

*Primary Examiner*—Forester W. Isen
*Attorney, Agent, or Firm*—Cahill, Sutton & Thomas

[57] ABSTRACT

The AM signal from a microphone is converted into an inaudible, FM signal which is combined with the AM signal to form a composite signal. The composite signal is amplified and converted into sound waves by a speaker. Any sound returning to the microphone from the speaker has an FM component and the FM component is demodulated to reconstruct the original AM sound. The reconstructed AM signal is subtracted from the signal from the microphone, thereby removing the echo and cancelling feedback.

19 Claims, 1 Drawing Sheet

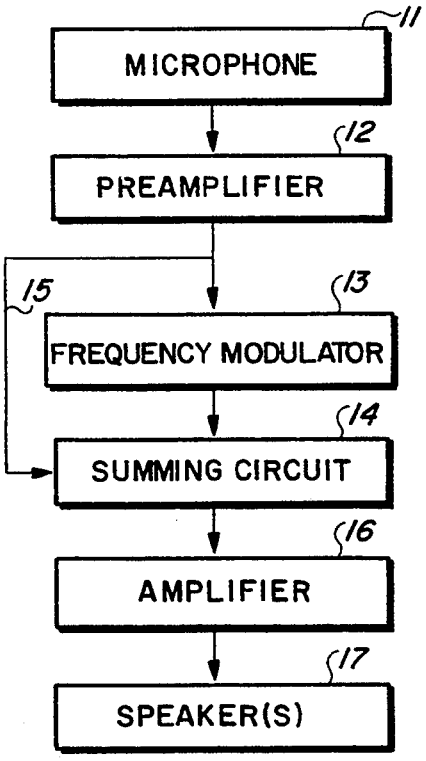
FIG. 1
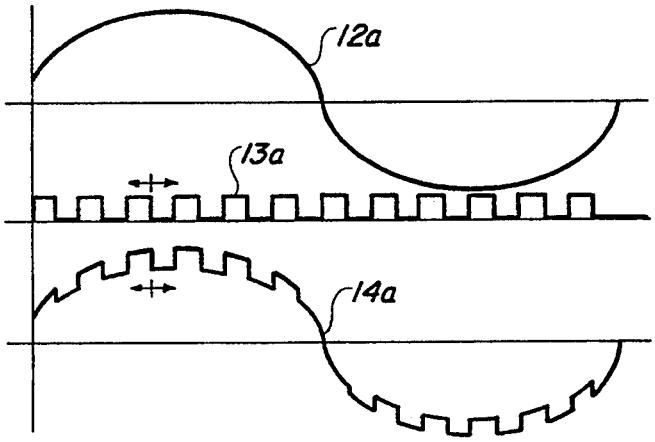
FIG. 2
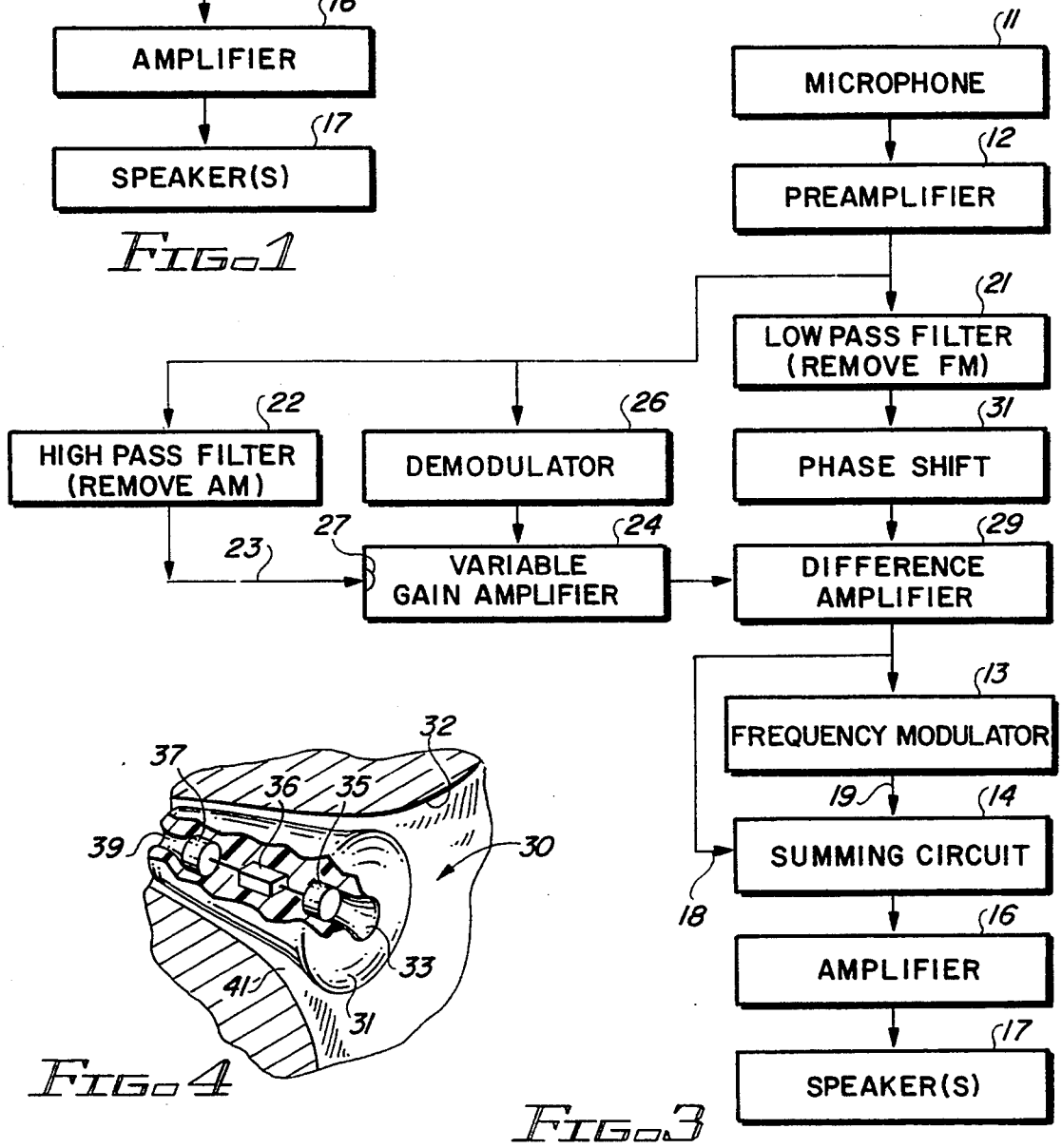
FIG. 3
FIG. 4

APPARATUS AND METHOD FOR REDUCING ACOUSTIC FEEDBACK

BACKGROUND OF THE INVENTION

This invention relates to feedback cancelling circuits and, in particular, to a circuit for reducing acoustic feedback in public address systems and in hearing aids.

A public address system is an "open loop" system in which sound is converted by a microphone into an electrical signal which is amplified and converted back into sound waves by one or more speakers. Sound waves are slight variations in air pressure which the microphone converts into an electrical signal of varying amplitude.

In theory, a signal passes through a public address system once, never to return. Outdoors and in well designed auditoriums or concert halls, this is essentially true. In other situations, a significant level of sound reaches the microphone from the speakers. When the output of an amplifier is coupled to the input of the amplifier, one has feedback, a closed loop with the potential to oscillate.

Acoustic feedback in a public address system can cause a mild echo or a self-sustaining ringing, depending upon the loudness of the sound returning to the microphone. The cause of the feedback can be poor placement of a speaker relative to the microphone, walls that reflect sound, and/or simply having the volume set too high on the amplifier.

In a hearing aid, a microphone is connected to a speaker by a high gain (60–80 db) amplifier and is quite close to the speaker in a fitted earpiece. The earpiece is assumed to fit the ear canal exactly and the tissue of the ear canal is relied upon to isolate the speaker from the microphone. If the earpiece should move slightly and not seal the ear canal, an acoustic path is opened, connecting the speaker to the microphone. The misalignment of the hearing aid manifests itself as an unpleasant squeal that is audible even to those several feet from the wearer. The squeal is eliminated by reducing the gain of the amplifier by way of an external volume control on the hearing aid. Often the wearer is obliged to adjust the gain frequently as the loudness of background sounds and sounds of interest changes. While feedback is an annoyance in a public address system, feedback in a hearing aid can be more serious since it interferes with hearing and may cause the wearer not to use the hearing aid. High level feedback in a hearing aid may even damage the already impaired hearing of the wearer.

There are two difficulties to eliminating feedback in an acoustic system. One difficulty is determining whether the sound passing through the amplifier is an echo or an original sound and the second difficulty is determining the travel time of the echo. In the prior art, a variety of systems have been proposed for detecting an echo, typically assuming that a single frequency tone of large amplitude is an echo. When an echo is detected, either the gain of the amplifier is reduced or the signal from the microphone is filtered to eliminate the tone. In a hearing aid, reducing the gain temporarily shuts off the hearing aid causing a silent gap in what is heard. Filtering out a frequency or band of frequencies can have the same effect if the frequencies happen to be those which need amplification to be heard. Some systems in the prior art have a calibration mode for determining the time delay of an echo in order to cancel the echo. These systems are not amenable to being incorporated into a hearing aid.

In view of the foregoing, it is therefore an object of the invention to provide a feedback cancelling circuit which does not squelch or reduce the gain of an amplifier.

Another object of the invention is to provide a feedback cancelling circuit which operates independently of the delay of the echo.

A further object of the invention is to provide a feedback cancelling circuit in which an original sound is reconstructed from an inaudible part of an echo and is subtracted from the audible part of the echo, thereby cancelling the echo.

SUMMARY OF THE INVENTION

The foregoing objects are achieved in the invention wherein sound is converted into an electrical signal by a microphone and the electrical signal is amplified. The electrical signal also is converted into an inaudible, frequency modulated (FM) signal which is combined with the signal from the microphone, amplified, and converted into sound waves by a speaker. Any sound travelling from the speaker back to the microphone has an FM component containing the original sound. The FM component is demodulated, reconstructing the original sound. The reconstructed original sound is subtracted from the signal from the microphone, thereby removing the echo and cancelling feedback.

Since the sound from the speaker is "tagged" with an FM component, it does not matter how much time is required for the sound to travel from the speaker to the microphone. The FM component preferably is detected in a phase locked loop circuit which inherently locks onto the loudest signal, thereby assuring that the loudest echo is cancelled if more than one echo arrive simultaneously at the microphone. The invention is particularly useful for hearing aids since the hearing aid is not shut off when an echo is detected, i.e. any new sound passes through the system unaffected.

BRIEF DESCRIPTION OF THE DRAWINGS

A more complete understanding of the invention can be obtained by considering the following detailed description in conjunction with the accompanying drawings, in which:

FIG. 1 is a block diagram of acoustic apparatus for converting original sound into sound having AM and FM components in accordance with the invention;

FIG. 2 is a group of waveforms illustrating the operation of the invention;

FIG. 3 is a block diagram of an echo cancelling circuit constructed in accordance with a preferred embodiment of the invention; and FIG. 4 illustrates a hearing aid constructed in accordance with the invention.

DETAILED DESCRIPTION OF THE INVENTION

FIG. 1 illustrates a simplified system for producing a sound from which an echo can be detected and cancelled in accordance with the invention. The echo cancelling portion of the system is included in FIG. 3. Referring to FIGS. 1 and 2, microphone 11 is connected to the input of preamplifier 12 which has an output connected to modulator 13. Waveform 12*a* represents a sinusoidal output signal from preamplifier 12. Modulator 13 produces frequency modulated signal 13*a* having a center frequency of 30 kilohertz (30,000 cycles per second). Frequency modulation is a vibrato-like variation of the center frequency in which the deviation from the center frequency, represented by arrow 18, is in step with the signal from microphone 11. The frequency modulated signal is inaudible since human hearing is insensitive to sound waves above approximately 20 khz.

The output from modulator 13 is connected to a first input of summing circuit 14. The output of preamplifier 12 is connected by line 15 to a second input of summing circuit 14 which combines the frequency modulated signal with the signal from microphone 11. The output signal from summing circuit 14, represented by waveform 14*a*, is coupled to amplifier 16 which drives speakers 17.

In a preferred embodiment of the apparatus of FIG. 1, microphone 11 is preferably an electret microphone, amplifier 12 is a transistor or operational amplifier, modulator 13 is a type 555 timer, summing circuit 14 is an operational amplifier or a transistor, amplifier 16 is an operational amplifer or a transistor, and speakers 17 are micro-speakers such as used in hearing aids. Generally, the amplifiers are transistors in a hearing aid and an integrated circuit in a PA system.

Speakers 17 must be capable of projecting a sound wave at 30 khz. For a hearing aid, this frequency is easily produced by the small speaker used. In public address systems, it may be necessary to add a super tweeter to the sound system in order to produce the frequency modulated component of the sound waves. The sound from speakers 17 has a frequency modulated (FM) component and an amplitude modulated (AM) component. As used herein, the AM component is a variable amplitude signal produced by microphone 11 in response to an original (audible) sound. (In radios, AM refers to amplitude modulation of a carrier. In the invention, there is no carrier, "AM component" or baseband audio refers to a variable amplitude signal.)

The apparatus of FIG. 1 converts original sound into a composite, louder sound having an AM component and an FM component. The FM component is derived from the AM component, i.e. the FM component includes the same information as the AM component, and the FM component provides a unique tag for the AM component since the FM component can only have been produced artificially. Thus, one can detect an echo by looking for an FM component in the signal from microphone 11. The FM component also provides a signal for removing an echo using the apparatus illustrated in FIG. 3, in which elements common to FIG. 1 have the same reference number.

The apparatus of FIG. 3 separates the incoming signal into an AM component and an FM component, reconstructs an echo from the FM component, and then subtracts the reconstructed echo from the AM component, thereby cancelling or nullifying the echo. Echo cancellation is independent of the acoustic delay since the FM and AM components travel together.

When an echo is received at microphone 11 (along with other sounds) the combined sounds are converted to an electrical signal by microphone 11 and amplified in preamplifier 12. The output of preamplifier 12 is connected to low pass filter 21, which removes the inaudible FM component and to high pass filter 22, which removes the AM component leaving only the FM component on line 23. The output from preamplifier 12 is also coupled to FM demodulator 26, which preferably includes a phase locked loop circuit. Phase locked loop circuits automatically lock onto the strongest signal, thereby assuring cancellation of any echo loud enough to cause ringing.

The output signal from demodulator 26 is an AM signal corresponding to the original sound and is connected to the signal input of variable gain amplifier 24. The output from high pass filter 22 is a signal proportional to the magnitude of the FM component and to the loudness of the echo. This signal is connected to gain control input 27 of variable gain amplifier 24. The output from variable gain amplifier 24 is a reconstructed echo of the original sound and this signal is coupled to one input of difference amplifier 29.

The output from low pass filter 21 is an AM signal containing the echo of the original sound plus additional signals. The second input to difference amplifier 29 is coupled to low pass filter 21 by phase shift circuit 31, described below. Difference amplifier 29 subtracts the reconstructed echo from the output of filter 21, leaving only the additional signals as a remainder.

The remainder is an AM signal, now a "new original" signal, coupled to input 18 of summing circuit 14. Input 19 of summing circuit 14 is connected to modulator 13. The AM component and FM component of the new original signal are combined in summing circuit 14, amplified in amplifier 16, and projected or transmitted by speakers 17.

In passing through the apparatus of FIG. 3, the AM component may become phase shifted relative to the FM component. Specifically, the FM component passes through modulator 13 and demodulator 26. These components may cause a sufficient phase shift in the reconstructed echo that the reconstructed echo does not cancel the echo. If so, phase shift circuit 31 is added to shift the phase of the echo by the same amount as the reconstructed echo is shifted. The adjustment for phase shift is made only once, at the time the circuit is constructed. The phase shift corrects for electrical delay internal to the apparatus of FIG. 3, the phase shift does not correct for external, acoustic delay of sound waves travelling from speakers 17 to microphone 11. The apparatus of FIG. 3 operates independently of acoustic delay because the FM and AM components travel together from the speaker to the microphone.

In a preferred embodiment of the invention, the filters can be RC networks or more elaborate filters depending upon whether the application is hearing aids, where components must be as small as possible, or in PA systems, where size is irrelevant. Demodulator 26 is preferably a type 565 PLL, amplifier 24 is preferably a JFET, difference amplifier 29 is a transistor or an operational amplifier, and phase shift circuit 31 can be a type 555 modulator and type 565 demodulator connected in series or an impedance.

The apparatus of FIG. 3 can be implemented in a single integrated circuit and incorporated into a hearing aid. In FIG. 4, hearing aid 30 includes elongated body 31 closely fitting within ear canal 32. At a first end of body 31, hole 33 couples sound to microphone 35. Microphone 35 is connected to integrated circuit 36 which is powered by a suitable battery (not shown). Speaker 37 transmits sound into ear canal 32 through hole 39 in a second end of body 31.

If a gap, such as indicated by reference number 41, forms between ear canal 32 and body 31, an acoustic path is opened between speaker 37 and microphone 35. The gain of circuit 36 is high and an echo quickly becomes sustained oscillation at a large amplitude. However, the apparatus shown in FIG. 3 prevents oscillation from occurring by cancelling the echo while continuing to amplify other sounds for the wearer. There is no need for an external volume control, as often used in hearing aids of the prior art, because the gain of integrated circuit 36 does not have to be changed to avoid or to cancel feedback. Thus, a hearing aid constructed in accordance with the invention can be more compact than hearing aids of the prior art.

The invention thus provides apparatus for subtracting an echo from a signal, thereby cancelling any feedback through the apparatus without changing the gain of the apparatus or any other characteristic. New sounds received by the microphone pass through the apparatus unaffected. This is particularly useful in hearing aids since sounds other than the echo are passed through to the speaker. The hearing aid does not squeal or go silent if there is an echo as in hearing aids of the prior art. The invention can be used anywhere there is an unwanted echo, not just in public address systems and hearing aids. Examples of other uses are telephone (including cordless, cellular, etc.), Karaoke type "boom boxes" (portable sound systems), and interactive multimedia systems (e.g. computers with two way voice communication).

Having thus described the invention it will be apparent to those of skilled in the art that various modifications can be made within the scope of the invention. For example, a summing circuit can be substituted for difference amplifier 29 if one of the signals to the circuit is inverted. Similarly, a difference amplifier can be substituted for summing circuit 14 if one signal is inverted. Summing circuit 14 can be a passive (resistive) network or an operational amplifier. The particular center frequency chosen for the FM signal is not critical but is preferably within the range of commercially available speakers. Thus, an FM signal having a center frequency of 25 to 50 kilohertz is suitable. While a phase locked loop demodulator is preferred, other FM detector circuits, such as a discriminator circuit, can be used instead.

I claim:

1. A method for reducing acoustic feedback, said method comprising the steps of:

projecting a composite acoustic signal having baseband audio and FM components;

sensing said composite acoustic signal and converting said composite acoustic signal into an electrical signal having a baseband audio component and an FM component;

separating said electrical signal into the baseband audio component and the FM component;

producing a reconstructed baseband audio component from said FM component; and subtracting said reconstructed baseband audio component from said baseband audio component.

2. The method as set forth in claim 1 wherein said producing step comprises:

passing said FM component through a demodulator to obtain a baseband audio output signal;

filtering said FM component to produce an amplitude signal;

coupling said baseband audio output signal and said amplitude signal to a variable gain amplifier for amplifying said baseband audio output signal by an amount determined by said amplitude signal to produce said reconstructed baseband audio component.

3. The method as set forth in claim 1 and further comprising the step of:

adjusting the phase of said baseband audio component of said acoustic feedback to be in phase with said reconstructed baseband audio component.

4. The method as set forth in claim 1 wherein said projecting step comprises the steps of:

converting a sound into a baseband audio signal; converting said baseband audio signal into an FM signal; combining said baseband audio signal and said FM signal to produce a composite signal; and coupling said composite signal to at least one loudspeaker.

5. The method as set forth in claim 1 wherein said FM component has a center frequency greater than 20 khz.

6. Apparatus for producing an audible signal having inaudible modulation, said apparatus comprising:

a preamplifier for amplifying a baseband audio signal, said preamplifier having an output;

a frequency modulator having an input coupled to the output of said preamplifier and an output, said modulator producing an output signal at least a portion of which is ultrasonic;

a summing circuit having an output and a first input coupled to the input of said frequency modulator and a second input coupled to the output of said frequency modulator; and an amplifier coupled to the output of said summing circuit.

7. The apparatus as set forth in claim 6 wherein said FM modulator has a center frequency greater than 20 khz.

8. The apparatus as set forth in claim 6 and further comprising:

a difference amplifier having a first input coupled to the output of said preamplifier, a second input, and an output coupled to the input of said frequency modulator; and a frequency demodulator having an input coupled to the output of said preamplifier and an output coupled to the second input of said difference amplifier.

9. The apparatus as set forth in claim 8 and further comprising:

a high pass filter having an input coupled to the output of said preamplifier and an output;

a variable gain amplifier having a gain control input coupled to the output of said high pass filter, a signal input coupled to the output of said frequency demodulator, and an output coupled to the second input of said difference amplifier.

10. The apparatus as set forth in claim 8 and further comprising:

a low pass filter having an input coupled to the output of said preamplifier and an output coupled to the first input of said difference amplifier.

11. The apparatus as set forth in claim 10 and further comprising:

a phase shift circuit having an input coupled to the output of said low pass filter and an output coupled to the first input of said difference amplifier.

12. The apparatus as set forth in claim 11 and further comprising:

a high pas filter having an input coupled to the output of said preamplifier and an output;

a variable gain amplifier having a gain control input coupled to the output of said high pass filter, a signal input coupled to the output of said frequency demodulator, and an output coupled to the second input of said difference amplifier.

13. In a hearing aid having an elongated body fitting within a human ear canal, said body having a first end and a second end, a microphone in said body adjacent said first end, a speaker in said body adjacent said second end, and a circuit electrically connecting said speaker to said microphone, said circuit comprising:

a preamplifier coupled to said microphone, said preamplifier having an output;

a frequency modulator having an input coupled to the output of said preamplifier, said modulator producing an output signal at least a portion of which is ultrasonic;

a summing circuit having a first input coupled to the output of said preamplifier and a second input coupled to said frequency modulator; and an amplifier having an input coupled to said sunning circuit and an output coupled to said speaker.

14. The hearing aid as set forth in claim 13 and further comprising:

a difference amplifier having a first input coupled to the output of said preamplifier, a second input, and an output coupled to the input of said frequency modulator; and a frequency demodulator having an input connected to the output of said preamplifier and an output coupled to the second input of said difference amplifier.

15. The hearing aid as set forth in claim 14 and further comprising:

a high pass filter having an input coupled to the output of said preamplifier and an output;

a variable gain amplifier having a gain control input coupled to the output of said high pass filter, a signal input coupled to the output of said frequency demodulator, and an output coupled to the second input of said difference amplifier.

16. The hearing aid as set forth in claim 14 and further comprising:

a low pass filter having an input coupled to the output of said preamplifier and an output coupled to the first input of said difference amplifier.

17. The hearing aid as set forth in claim 16 and further comprising:

a phase shift circuit having an input coupled to the output of said low pass filter and an output coupled to the first input of said difference amplifier.

18. The hearing aid as set forth in claim 17 and further comprising:

a high pass filter having an input coupled to the output of said preamplifier and an output;

a variable gain amplifier having a gain control input coupled to the output of said high pass filter, a signal input coupled to the output of said frequency demodulator, and an output coupled to the second input of said difference amplifier.

19. A method for cancelling acoustic feedback of an original sound, said acoustic feedback having an audible part and an inaudible part, said method comprising the steps of:

projecting said original sound and an inaudible carrier frequency modulated by said original sound;

reconstructing said original sound from the inaudible part of said acoustic feedback; and subtracting the reconstructed original sound from the audible part of said acoustic feedback.

* * * * *